United States Patent [19]

Ooka

[11] 3,954,599

[45] May 4, 1976

[54] PROCESS FOR PRODUCING CRACKED GAS AND CRACKED OIL FROM HEAVY HYDROCARBONS

[75] Inventor: Isami Ooka, Neyagawa, Japan

[73] Assignee: Osaka Gas Company, Limited, Osaka, Japan

[22] Filed: Mar. 5, 1974

[21] Appl. No.: 448,187

Related U.S. Application Data

[63] Continuation-in-part of Ser. No. 367,225, June 7, 1973, abandoned.

[30] Foreign Application Priority Data

Mar. 7, 1973 Japan ..... 48-27524

[52] U.S. Cl. ..... 208/89; 48/215; 208/126; 208/127; 208/130; 208/172

[51] Int. Cl.[2] ..... C10G 9/30

[58] Field of Search ..... 208/126, 127, 130, 48 Q, 208/172, 107, 89; 260/683 R; 48/215

[56] References Cited

UNITED STATES PATENTS

| | | | |
|---|---|---|---|
| 2,662,005 | 12/1953 | Evans | 48/197 |
| 2,752,407 | 6/1956 | Cahn | 260/683 R |
| 2,784,068 | 3/1957 | Beggs et al. | 48/74 |
| 2,906,792 | 9/1959 | Kilpatrick | 260/683 R |
| 3,202,603 | 8/1965 | Keith et al. | 208/107 |
| 3,259,565 | 7/1966 | Kimberlin | 208/127 |

*Primary Examiner*—Herbert Levine
*Attorney, Agent, or Firm*—Larson, Taylor & Hinds

[57] ABSTRACT

In producing cracked gas and cracked oil by thermally cracking a heavy hydrocarbon within a reactor in which a granular solid, steam and oxygen form a fluidized bed or moving bed, a process which is characterized in that the heavy hydrocarbon is supplied to the upper portion of the reactor and part of the granular solid is discharged from the bottom of the reactor and thereafter fed again to the upper portion of the reactor, to thereby maintain the upper portion at a temperature of not higher than 550°C.

10 Claims, 4 Drawing Figures

PROCESS FOR PRODUCING CRACKED GAS AND CRACKED OIL FROM HEAVY HYDROCARBONS

Figure 2:
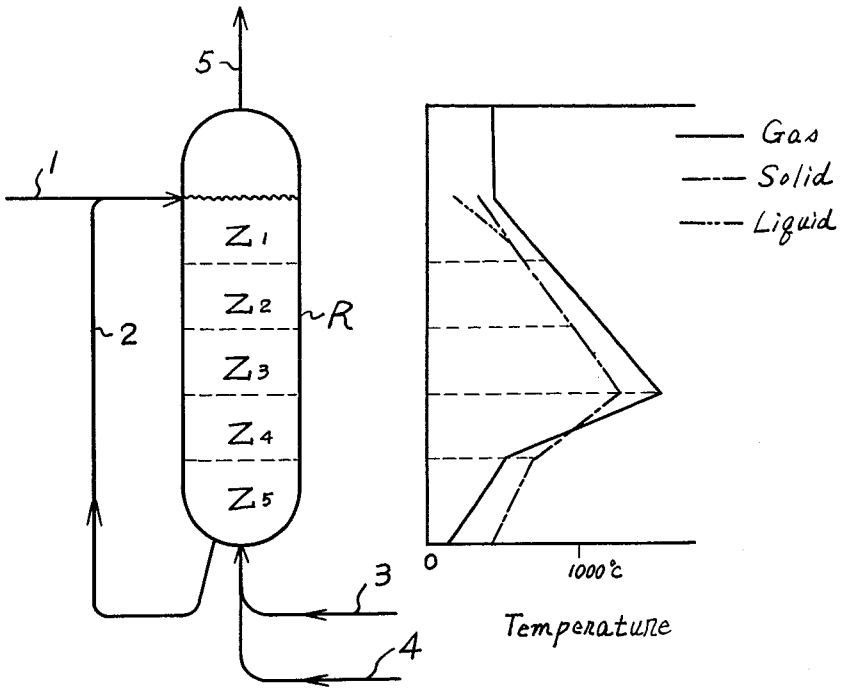

This application is a continuation-in-part of my copending Application Ser. No. 367,225 filed on June 7, 1973 now abandoned.

This invention relates to a process for producing cracked gas and cracked gas and cracked oil from heavy hydrocarbons, more particularly to an improvement in a process for producing cracked gas and cracked oil by thermally cracking heavy hydrocarbons and partially oxidizing a thermally cracked residue in a reactor.

It is already known to produce hydrogen, methane, ethane, ethylene, propylene and like gases by the thermal cracking of heavy hydrocarbons. According to the known process, heavy hydrocarbons introduced into a reactor along with steam and oxygem are thermally cracked. However, this process permits high-boiling by-products such as tar and pitch to be deposited on the interior wall of the reactor and to undergo polycondensation at a high temperature to form carbon, making it difficult to operate the reactor for a long period of time. An attempt has therefore been made to form a fluidized bed of granular solid within the reactor to take out from the reactor tar, pitch and like high-boiling substances along with the solid as deposited thereon, but this method still fails to discharge all the high-boiling substances from the reactor, permitting part of the same to be deposited on the interior wall of the reactor and to form carbon and thereby making it impossible to operate the reactor for a long period of time. Moreover, the high-boiling substances must be removed from the granular solid by burning or partial oxidation for gasification, which requires another furnace, consequently rendering the apparatus complex and the process costly.

A main object of this invention is to provide a process for gasifying heavy hydrocarbons by thermal cracking which has overcome the drawbacks of conventional processes.

Another object of this invention is to provide a process for gasifying heavy hydrocarbons by thermal cracking which makes it possible to operate the reactor continuously for a prolonged period of time without causing the deposition of tar, pitch and like highboiling substances on the interior wall of the reactor.

Another object of this invention is to provide a process for gasifying heavy hydrocarbons by thermal cracking by which tar, pitch and like high-boiling substances deposited on the granular solid of fluidized or moving bed can be gasified within the reactor by cracking and/or partial oxidation without the necessity to take them out from the reactor.

Still another object of this invention is to provide a process for gasifying heavy hydrocarbons by thermal cracking which is capable of producing not only cracked gas but also cracked oil.

Other objects and features of this invention will become apparent from the following description.

In producing cracked gas and cracked oil by thermally cracking a heavy hydrocarbon within a reactor in which a granular solid, steam and oxygen form a fluidized bed or moving bed, the present invention is characterized in that the heavy hydrocarbon is supplied to the upper portion of the reactor and part of the granular solid is discharged from the botton of the reactor and thereafter fed again to the upper portion of the reactor, to thereby maintain the upper portion at a temperature of not higher than 550°C.

I have conducted researches using a reactor including a fluidized bed or moving bed formed of a granular solid, steam and oxygen. In the case where part of the granular solid is taken out from the bottom of the reactor and then fed to the upper portion of the reactor along with heavy hydrocarbons to thereby maintain the upper portion at a temperature of not higher than 550°C, it has been found that tar, pitch and like high-boiling substances deposited on the upper interior wall of the reactor do not undergo polycondensation and carbonization at such low temperature of not higher than 550°C, with the result that they are easily removed from the wall by the granular solid introduced into the reactor and get deposited thereon. I have also found that while descending in the interior of the reactor, the high-boiling substances deposited on the granular solid react with the steam and oxygen supplied from the lower portion of the reactor and are thereby gasified, so that there is no need to use an additional furnace for the removal of high-boiling substances. Moreover, the heavy hydrocarbons and the granular solid supplied to the upper portion of the reactor are heated by the high temperature gaseous mixture ascending in the interior of the reactor and subjected to thermal cracking while descending. Therefore, in the present process, high heat efficiency can be attained with the result that amounts of steam and oxygen required for the reaction are considerably reduced and high calorific gas can be obtained with low contents of diluents.

Thus the process of this invention makes it possible to use a simplified reaction apparatus and to operate the apparatus continuously for a prolonged period of time with a lower heat consumption, whereby cracked gas and cracked oil can be obtained from heavy hydrocarbons inexpensively.

The heavy hydrocarbons to be thermally cracked by the process of this invention are petroleum hydrocarbons containing at least 50 vol.% of fractions boiling at 350°C or higher, exemplars of which are crude oil, residual oil, pitch, etc.

According to this invention, it is required that the temperature of upper portion of the reactor be not higher than 550°C, preferably 350°– 450°C. Temperatures exceeding 550°C are objectionable, since tar, pitch and like high-boiling substances deposited on interior wall of the reactor tend to undergo polycondensation at higher temperatures to form carbon.

The granular solids to be used in this invention are those conventionally used in the thermal cracking of hydrocarbons and include substances such as coke, alumina, silica, and zirconia. Preferably, the granular solid is in the range of 0.1 to 10 mm in grain size. Where desired, those having grain sizes outside this range may be used.

The amount of the granular solid to be charged into the reactor is 0.2 to 5 times, preferably 0.8 to 1.5 times, the weight of the heavy hydrocarbons. To control the temperature of upper portion of the reactor, the granular solid discharged from the bottom of the reactor is recycled to the top of the reactor. Preferable temperature of the granular solid to be recycled is in the range of about 200 to 400°C.

Usable as the oxygen sources are oxygen, air and mixture of oxygen and one or more other gases. The concentration of oxygen is selected in accordance with the compositions of cracked gas and cracked oil desired. The amount of oxygen to be supplied to the reactor is also widely variable with the kinds of heavy hydrocarbons and the temperature thereof, the amount of steam to be supplied, etc. It is generally not lower than 10 wt.%, preferally 10 to 20 wt.%, based on the heavy hydrocarbons. The amount of oxygen to be used in the present process is considerably lower than that required in the conventional process. Usually it is reduced to the amount of about 50 – 80% of the latter.

The amount of steam to be supplied to the reactor is not less than 0.5 mole, preferably 1.0 to 1.5 moles, per mole of oxygen used.

The reaction pressure is usually atmospheric pressure, but an increased pressure up to 70 $Kg/cm^2$ or higher can be employed.

Figure 1:
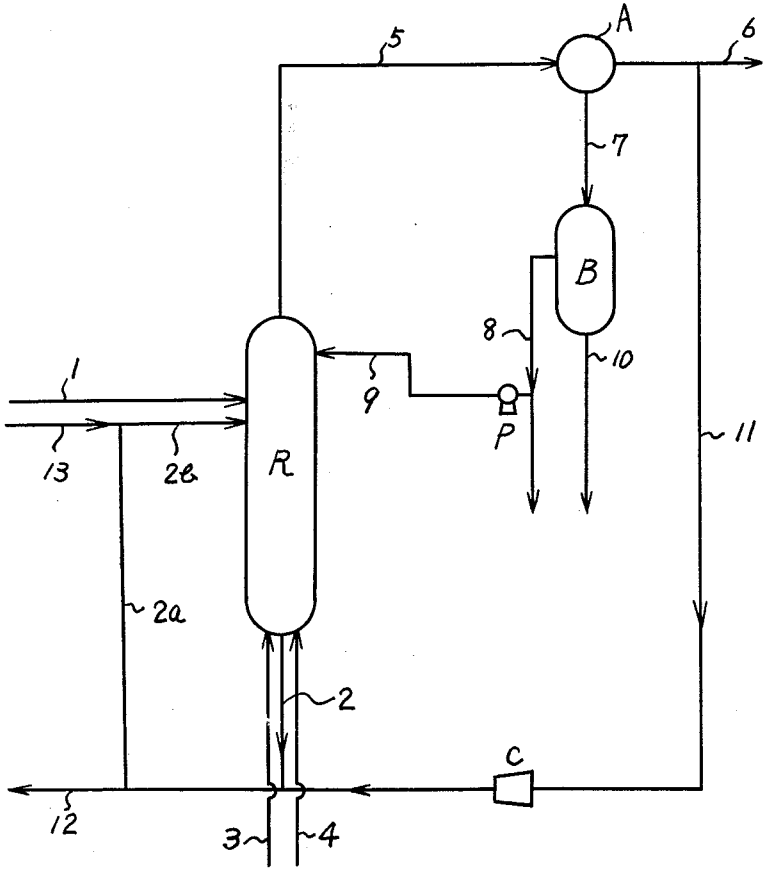
Figure 3:
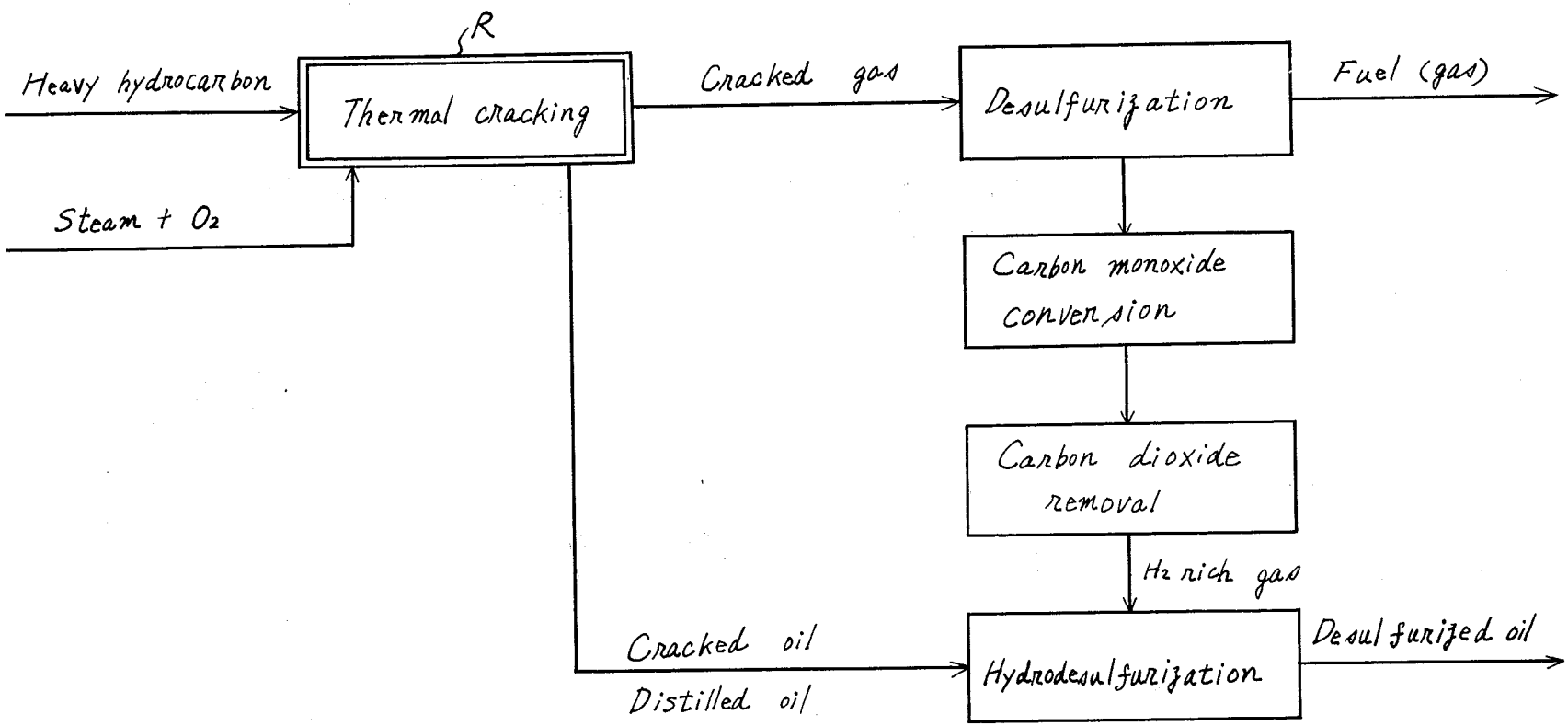
Figure 4:
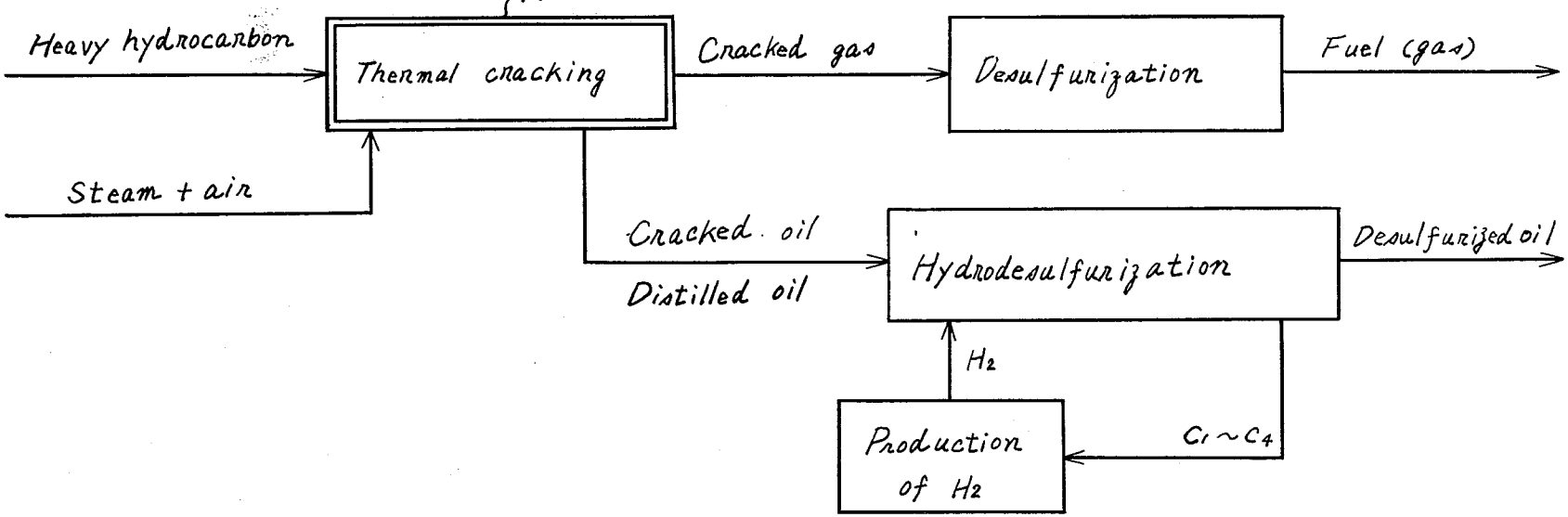

The process of this invention will be described below in greater detail with reference to the accompanying drawings, in which:

FIG. 1 is a flow chart showing the principle of the process of this invention;

FIG. 2 gives a diagram showing main reactions in the reactor and a graph showing the distributions of temperatures of gas, solid and liquid; and FIGS. 3 and 4 are flow charts showing applications of the process of this invention respectively.

Heavy hydrocarbons to be treated are supplied through a line 1 to a reactor R at room temperature or after preheated when so desired. The heavy hydrocarbons must be charged into the reactor R from the upper portion thereof, i.e., from above a fluidized bed or moving bed therein formed of a granular solid, steam and oxygen. Part of the granular solid is taken out from the bottom of the reactor R through a line 2, cooled by a cooler (not shown), if necessary, and recycled to the upper portion of the reactor through lines 2*a* and 2*b*. Steam and oxygen are fed to the reactor R through lines 3 and 4 respectively. thus the upper portion of the reactor R is cooled by the heavy hydrocarbon and recycling granular solid to be fed thereto to thereby be maintained at a temperature of not higher than 550°C. The granular solid may preferably be recycled continuously but may be recycled intermittently in some cases. Although steam and oxygen are fed to the reactor R separately in the apparatus of FIG. 1, they can of course be supplied in a mixture form through the same line. While the granular solid and heavy hydrocarbons descend through the interior of the reactor R as mixed together, they are heated by a gaseous mixture of high temperature ascending in the interior of the reactor. Thus lower-boiling substances in the heavy hydrocarbons are evaporated. The heavy hydrocarbons from which the lower-boiling substances are evaporated continue to descend in the interior of the reactor R are deposited on the granular solid and are thermally cracked to cracked gas and cracked oil. The residue resulting from thermal cracking and predominantly comprising tar, pitch and like high-boiling substances react with a high-temperature gas for reduction and oxidation and are thereby gasified while further descending through the interior of the reactor R. The cracked gas, cracked oil and low boiling substances evaporated in the reactor R are sent out from the top of the reactor, passed through a line 5 to a condenser A, in which gas is separated from condensate. The gas is sent to a storage tank (not shown) by way of a line 6, whilst the condensate is sent through a line 7 to a separator B, in which oil is separated from water. To further control the temperature of the upper portion of the reactor R, a portion of oil discharged from the separator B through a line 8 may be recycled to the top of the reactor by a pump P and through a line 9 when so desired. The separated water is run off from the system through a line 10, and may be utilized as a source of steam to be supplied to the reactor R. The granular solid is recycled from the bottom of the reactor to its upper portion by any desired means such as mechanical means like an elevator conveyor or pressure feed means utilizing steam or the like. Advantageously, however, a portion of the gas discharged from the system through the line 6 is sent through a line 11 to a compressor C, and the gas thus pressurized is then supplied to the line 2 to supply to the upper portion of the reactor the granular solid discharged from the bottom thereof. Through a long-term continuous operation, ashes resulting from the combustion of high-boiling fractions and heavy metals and the like contained in the heavy hydrocarbon material tend to be deposited on the surface of the granular solid, so that a portion of the granular solid may preferably be taken out from the system through a line 12 for regeneration, while fresh granular solid and/or regenerated granular solid may be charged into the system through a line 13.

The principal reactions involved in the process of this invention will be described with reference to the graph of FIG. 2. The ordinate of the graph represents the distance from the bottom of the reactor to its top. While progressively descending within the reactor, the granular solid is gradually heated and reaches the highest temperature in an intermediate zone between reduction zone $Z_3$ and oxidation zone $Z_4$. The solid thereafter gives sensible heat to the gaseous mixture of steam and oxygen in the lower portion (preheating zone $Z_5$) of the reactor, thereby being reduced in temperature, and reaches the bottom of the reactor. The granular solid is taken out from the bottom of the reactor and recycled to cool the upper portion $Z_1$ of the reactor. The heavy hydrocarbons in the form of a liquid phase cool the upper portion $Z_1$ of the reactor, are subjected to heat exchange with an ascending gas in the vicinity of their inlet, permitting a lower-boiling fraction to evaporate or distill off, and reach the same temperature as the granular solid. The heavy hydrocarbons subsequently descend within the reactor while undergoing cracking, reduction and oxidation in cracking zone $Z_2$, reduction zone $Z_3$ and oxidation zone $Z_4$. The gas phase comprising steam and oxygen supplied from the bottom of the reactor R is subjected to heat exchange with the descending granular solid and is thereby preheated in the lower portion $Z_5$ of the reactor R. Subsequently in the oxidation zone $Z_4$, the gas phase undergoes sudden exothermic reaction with the heavy hydrocarbons and is thereby rapidly heated to a higher temperature than the granular solid and thereafter retains a higher temperature than the solid until it reaches the upper portion $Z_1$ of the reactor R. To assure effective thermal cracking of heavy hydrocarbons in the present process, the interior of the reactor preferably includes an area in which the solid and gas phases have temperatures of at least 800°C and which extends over the reduction zone $Z_3$ and oxidation zone $Z_4$.

The process of this invention is employable for various applications. For example, in the process for producing desulfurized oil shown in the flow chart of FIG. 3, heavy hydrocarbons of high sulfur contents obtained by atmospheric distillation or vacuum distillation of crude oil are thermally cracked with steam and oxygen having a purity of not lower than about 95%. The cracked gas is then subjected to the steps of desulfurization, carbon monoxide conversion and carbon dioxide removal and is thereby modified to a hydrogen-rich gas, with which the cracked oil and distilled oil resulting from the thermal cracking are hydrogenated and desulfurized to obtain desulfurized oil. Excess cracked gas is used as a fuel.

FIG. 4 shows another example of the process for producing desulfurized oil incorporating the present process. In this process, heavy hydrocarbons obtained by distillation of crude oil under atmospheric or reduced pressure is thermally cracked in accordance with the present process with steam and air. The cracked gas produced is then desulfurized and is directly used as a fuel gas. The cracked oil is subjected to hydrodesulfurization to obtain a desulfurized oil. In this process it is advantageous to produce hydrogen from the $C_1$ to $C_4$ fractions obtained from the hydrodesulfurization step and to recycle it to hydrodesulfurization step.

For a better understanding of this invention, examples are given below, in which an apparatus similar to one shown in FIG. 1 was used.

EXAMPLE 1

8.9 kg/hr of steam and 82.0 $Nm^3$/hr of air were supplied to a reactor R through a line 3 and a line 4, respectively, and subjected to heat exchange with coke grains having an average grain size of 6 mm and recycled to the reactor R through a line 2. 100 kg/hr of residual oil preheated to 350°C and having the composition and properties listed in Table 1 below was fed to the upper portion of the reactor R which was maintained at about 425°C and brought into contact with hot gas ascending from the lower portion of the reactor for thermal cracking.

Table 1

| Composition of residual oil (wt.%) | | Specific gravity | Calorific value |
|---|---|---|---|
| C: | 85.2 | 0.958 | 10,200 Kcal/kg |
| H: | 10.8 | | |
| S: | 3.8 | | |

The amount of coke grains fed was 1.5 times the weight of the heavy hydrocarbon, interior pressure of the reactor was about 0.5 kg/cm²G and maximum temperature in the reactor was about 1,100°C.

The resulting cracked gas and oil were sent through a line 5 to a condenser A to be cooled to a temperature of about 40°C, by which 114.1 $Nm^3$/hr of gas was separated from condensate. The condensate was sent from the condenser A through a line 7 to a separator B, in which 74.1 kg/hr of oil was separated from 5.5 kg/hr of water. Table 2 below gives the composition and properties of the cracked gas obtained, and Table 3 shows the composition and properties of the oil obtained.

Table 2

| Calorific value : | 1,570 Kcal/$Nm^3$ |
|---|---|
| Specific gravity: (relative to air) | 0.940 |
| Component | |
| $CO_2$ | 7.1 vol.% |
| CO | 22.9 " |
| $H_2$ | 7.7 " |
| $H_2S$ | 1.2 " |

Table 2-continued

| Calorific value : | 1,570 Kcal/$Nm^3$ |
|---|---|
| Specific gravity: (relative to air) | 0.940 |
| Component | |
| $CH_4$ | 2.1 " |
| $C_2H_6$ | 0.5 " |
| $C_2H_4$ | 0.6 " |
| $C_3$ | 0.5 " |
| $C_4$ | 0.3 " |
| $O_2$ | 0.1 " |
| $N_2$ | 57.0 " |

Table 3

| Calorific value: | 10,700 Kcal/kg | |
|---|---|---|
| Specific gravity: | 0.85 | |
| Elementary analysis: | C | 84.7 wt.% |
| | H | 12.9 " |
| | S | 2.3 " |

In this example, coke grains having a temperature of 250°C were taken out from the bottom of the reactor at a rate of 75 kg/hr, cooled to 200°C and then recycled to the upper portion of the reactor.

EXAMPLE 2

19.0 kg/hr of steam and 17.1 $Nm^3$/hr of oxygen having a purity of 99.9 wt.% were supplied to a reactor R through a line 3 and a line 4, respectively, and subjected to heat exchange with alumina grains having an average grain size of 6 mm and recycled to the reactor R through a line 2. The same heavy hydrocarbon as used in Example 1 was fed to the reactor R in the same manner as in Example 1 to obtain 59.0 $Nm^3$/hr of cracked gas shown in Table 4 below and 72.4 kg/hr of oil shown in Table 5 below. The amount of alumina charged in was 0.8 time the weight of the heavy hydrocarbon, the interior pressure of the reactor was about 20 kg/cm²G, and the maximum temperature thereof was about 1,200°C.

Table 4

| Calorific value: | 3,310 Kcal/$Nm^3$ |
|---|---|
| Specific gravity: (relative to air) | 0.826 |
| Component : | |
| $CO_2$ | 20.5 vol. % |
| CO | 41.1 " |
| $H_2$ | 27.9 " |
| $H_2S$ | 2.6 " |
| $CH_4$ | 4.8 " |
| $C_2H_6$ | 1.5 " |
| $C_2H_4$ | 0.5 " |
| $C_3$ | 0.7 " |
| $C_4$ | 0.3 " |
| $O_2$ | 0.0 " |
| $N_2$ | 0.1 " |

Table 5

| Calorific value: | 10,700 Kcal/kg | |
|---|---|---|
| Specific gravity: | 0.85 | |
| Elementary analysis: | C | 84.8 wt.% |
| | H | 12.9 " |
| | S | 2.2 " |

In this example, alumina grains having a temperature of about 400°C were withdrawn from the bottom of the reactor at a rate of 40 kg/h, cooled to 200°C and then recycled to the upper portion of the reactor.

What I claim is:

1. In producing cracked gas and cracked oil by thermally cracking a heavy hydrocarbon within a reactor into the lower portion of which are introduced steam and oxygen so as to flow countercurrently to a moving bed comprising a granular solid, a process which comprises supplying the heavy hydrocarbon to the upper portion of the reactor from above the moving bed, discharging part of the granular solid from the bottom of the reactor and thereafter feeding it again to the upper portion of the reactor, to thereby maintain the upper portion of said reactor at a temperature of up to 550°C.

2. The method according to Claim 1, in which said temperature of upper portion of the reactor is maintained in the range of 350 to 450°C.

3. The method according to claim 1, in which said granular solid is in the range of 0.1 to 10 mm in grain size.

4. The method according to claim 1, in which the amount of said granular solid to be charged into the reactor is 0.2 to 5 times the weight of the heavy hydrocarbon.

5. The method according to claim 4, in which said amount of granular solid is 0.8 to 1.5 times the weight of the heavy hydrocarbon.

6. The method according to Claim 1, in which said granular solid to be recycled to the upper portion of the reactor has a temperature of 200 to 400°C.

7. The method according to claim 1, in which the amount of said oxygen to be supplied into the reactor is at least 10 wt.%, based on the heavy hydrocarbon.

8. The method according to claim 7, in which said amount of the oxygen is 10 to 20 wt.%.

9. The method according to Claim 1, in which the amount of said steam to be supplied into the reactor is at least 0.5 mole per mole of the oxygen used.

10. The method according to claim 9, in which said amount of the steam is 1.0 to 1.5 moles per mole of the oxygen used.

* * * * *